US007542009B2

(12) United States Patent
Hsu et al.

(10) Patent No.: US 7,542,009 B2
(45) Date of Patent: Jun. 2, 2009

(54) WIRELESS COMMUNICATION DEVICE AND SIGNAL RECEIVING/TRANSMITTING METHOD THEREOF

(75) Inventors: Heng-Ming Hsu, Taichung (TW); Kuo-Hsun Huang, Taichung (TW)

(73) Assignees: United Microelectronics Corp., Hsinchu (TW); National Chung Hsing University, Taichung (TW)

( * ) Notice: Subject to any disclaimer, the term of this patent is extended or adjusted under 35 U.S.C. 154(b) by 0 days.

(21) Appl. No.: 11/681,969

(22) Filed: Mar. 5, 2007

(65) Prior Publication Data

US 2008/0218428 A1 Sep. 11, 2008

(51) Int. Cl.
*H01Q 1/36* (2006.01)
*H01Q 3/24* (2006.01)

(52) U.S. Cl. ..... 343/895; 343/876; 343/702

(58) Field of Classification Search ..... 343/895, 343/876, 700 MS, 702
See application file for complete search history.

(56) References Cited

U.S. PATENT DOCUMENTS

| | | | | |
|---|---|---|---|---|
| 6,433,745 | B1 * | 8/2002 | Nagumo et al. | 343/700 MS |
| 6,588,002 | B1 | 7/2003 | Lampaert et al. | |
| 2003/0184403 | A1 | 10/2003 | Goyette et al. | |
| 2005/0068146 | A1 * | 3/2005 | Jessie | 336/200 |
| 2007/0279287 | A1 * | 12/2007 | Castaneda et al. | 343/700 MS |

* cited by examiner

*Primary Examiner*—Hoang V Nguyen
(74) *Attorney, Agent, or Firm*—J.C. Patents

(57) ABSTRACT

A wireless communication device using a single spiral inductor antenna and a signal receiving/transmitting method thereof operated on multi-band are provided. The single spiral inductor antenna is designed to have a plurality of different inductance paths. Different inductance values are inducted with signal paths switched by a plurality of switches so as to meet the requirements of multi-band operation. As the circuit structure of the single spiral inductor antenna is used, the circuit area is reduced effectively.

12 Claims, 5 Drawing Sheets

WIRELESS COMMUNICATION DEVICE AND SIGNAL RECEIVING/TRANSMITTING METHOD THEREOF

BACKGROUND OF THE INVENTION

1. Field of Invention

The present invention relates to a wireless communication device. More particularly, the present invention relates to a wireless communication device which only needs a single antenna and a plurality of switches to realize multi-band operation.

2. Description of Related Art

With rapid development in WLAN, multimode operations or multi-band operations have gradually become more mature. Currently, common WLAN standards include 802.11a, 802.11b and 802.11g. The 802.11a WLAN standard operates at 5.2 GHz, while the 802.11b and 802.11g WLAN standards operate at 2.4 GHz.

These WLAN standards have their own advantages, operational features and cost features, and certainly disadvantages. The multimode operation can integrate the advantages of these standards, and make up for the disadvantages.

For example, the multimode operation at least has the following advantages. Firstly, the multimode operation may be advantageous in terms of the cost. Secondly, the multimode operation supports various transmission speeds, which best satisfies future market demands. Thirdly, the multimode operation meets different power requirements at the same time. Fourthly, the multimode operation satisfies the requirements on the coverage scope and data transmission speed simultaneously.

To realize the multimode/multi-band operation, two sets of RF signal transceivers are adopted in a conventional WLAN card or WLAN router. Each set of RF signal transceiver has to be used together with a spiral inductor antenna. FIG. 1 is a schematic view of a dual-band WLAN card. The dual-band WLAN card can operate at 2.4 GHz and 5.2 GHz. When operating at 2.4 GHz, an RF transceiver 101 and a spiral inductor antenna 103 are used to receive and transmit 2.4 GHz RF signals. In another aspect, when operating at 5.2 GHz, an RF transceiver 102 and a spiral inductor antenna 104 are used to receive and transmit 5.2 GHz RF signals. It should be noted that the inductance values and Q values of the spiral inductor antennae 103, 104 are different.

Though the dual-band WLAN card is not difficult to design, the circuit area thereof cannot be easily reduced, as an inductor occupies a large area in the circuit layout, and the dual-band WLAN card needs two inductors of different inductance values and different Q values to realize the desired dual-band operation.

Therefore, it is preferred to develop a wireless communication device (such as a WLAN card or a WLAN router) operating at dual-band or even multi-band with a small circuit area.

SUMMARY OF THE INVENTION

The present invention is directed to provide a wireless communication device (such as a WLAN card or a WLAN router) operating at dual-band or even multi-band with a small circuit area, and a signal receiving/transmitting method thereof.

The present invention is further directed to provide a wireless communication device (such as a WLAN card or a WLAN router) operating at dual-band or even multi-band and a signal receiving/transmitting method thereof, which only needs a single inductor antenna and a plurality of switches to realize the desired function.

The present invention provides a wireless communication device operating at multi-band. The wireless communication device comprises a single spiral inductor antenna, a wireless signal transceiver, a plurality of switches and a control signal generator. The single spiral inductor antenna has a plurality of inductance paths, and inductance values inducted by the inductance paths are different from one another. Different inductance values are corresponding to operations in different bands. The signal transceiver receives and transmits a wireless signal. The on/off states of the switches determine which inductance path the wireless signal is transmitted on in the antenna. The control signal generator sends a control signal to the switches to determine the on/off states of the switches.

In the above wireless communication device, the antenna has at least a first inductance path and a second inductance path.

In the above wireless communication device, the switches comprise a first switch and a second switch coupled to the antenna and the signal transceiver, wherein the on/off states of the first switch and the second switch determine whether the wireless signal is transmitted on the first inductance path or the second inductance path in the antenna.

In addition, the present invention also provides a wireless communication device operating at multi-band. The wireless communication device comprises an antenna, a signal transceiver and a switch circuit. The antenna has at least a first inductance path and a second inductance path, wherein the inductance values inducted by the first inductance path and the second inductance path are different. The signal transceiver is coupled to the antenna. The signal transceiver receives and transmits a wireless (RF) signal. The switch circuit is coupled to the antenna and the signal transceiver. The conducting state of the switch circuit determines whether the wireless signal is transmitted on the first inductance path or the second inductance path in the antenna.

The wireless communication device further comprises a control signal generator, which sends a control signal to the switch circuit to determine the conducting state of the switch circuit.

In the wireless communication device, the antenna is a spiral inductor antenna.

In the above wireless communication device, the switch circuit comprises a first switch and a second switch. The first switch is coupled to the antenna, the signal transceiver and the control signal generator. When the first switch is turned on, the wireless signal is transmitted on the first inductance path. The second switch is coupled to the antenna, the signal transceiver and the control signal generator. When the second switch is turned on, the wireless signal is transmitted on the second inductance path.

Moreover, the present invention further provides a wireless communication device operating at a first band and a second band. The wireless communication device comprises an antenna, a signal transceiver, a first switch, a second switch and a control signal generator. The antenna has at least a first inductance path and a second inductance path. The first inductance path is corresponding to an operation of the wireless communication at the first band. The second inductance path is corresponding to an operation of the wireless communication at the second band. The signal transceiver is coupled to the antenna, and the signal transceiver receives and transmits a wireless signal. The first switch and the second switch are both coupled to the antenna and the signal transceiver. The on/off states of the first and second switches determine whether the wireless signal is transmitted on the first inductance path or the second inductance path in the antenna. The control signal generator determines the on/off states of the first and second switches.

In the wireless communication device, the antenna is a spiral inductor antenna.

Moreover, the present invention also provides a wireless signal receiving/transmitting method, comprising the following steps: providing a spiral inductor antenna having a plurality of inductance paths; providing a signal transceiver for receiving and transmitting a wireless signal; providing a switch circuit, wherein the conducting state of the switch circuit determines the transmission path of the wireless signal in the spiral inductor antenna; and using a control signal generator to send a control signal to the switch circuit, so as to control the conducting state of the switch circuit.

In the wireless signal receiving/transmitting method, the spiral inductor antenna has at least a first inductance path and a second inductance path.

In the above wireless signal receiving/transmitting method, the switch circuit comprises a first switch and a second switch, wherein the on/off states of the first and second switches determine whether the wireless signal is transmitted on the first inductance path or the second inductance path in the spiral inductor antenna.

In order to make the aforementioned and other objectives, features and advantages of the present invention comprehensible, preferred embodiments accompanied with figures are described in detail below.

DESCRIPTION OF EMBODIMENTS

In order to effectively reduce circuit area and to realize multi-band operation, in embodiments of the present invention, a single inductor, an RF signal transceiver and a plurality of switches are adopted. Hereinafter, operations at 2.4 GHz and 5.2 GHz are taken as examples to illustrate the present invention. It is known to those skilled in the art that this embodiment is also applicable to other bands. Furthermore, those skilled in the art can figure out how the embodiments are applied to the triple-band operation mode or even multi-band operation mode according to the illustration below.

Figure 1:
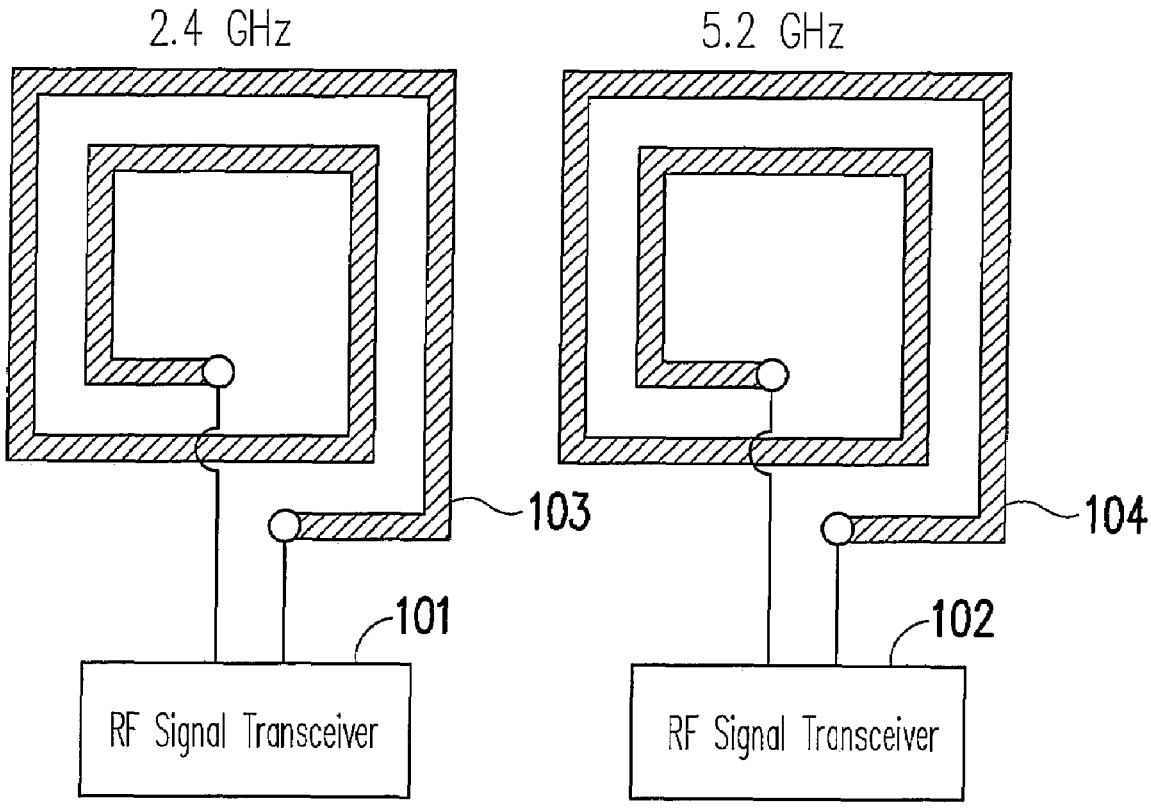
FIG. 1 (PRIOR ART)
FIG. 1 is a schematic view of a conventional multi-band wireless communication device.
Figure 2:
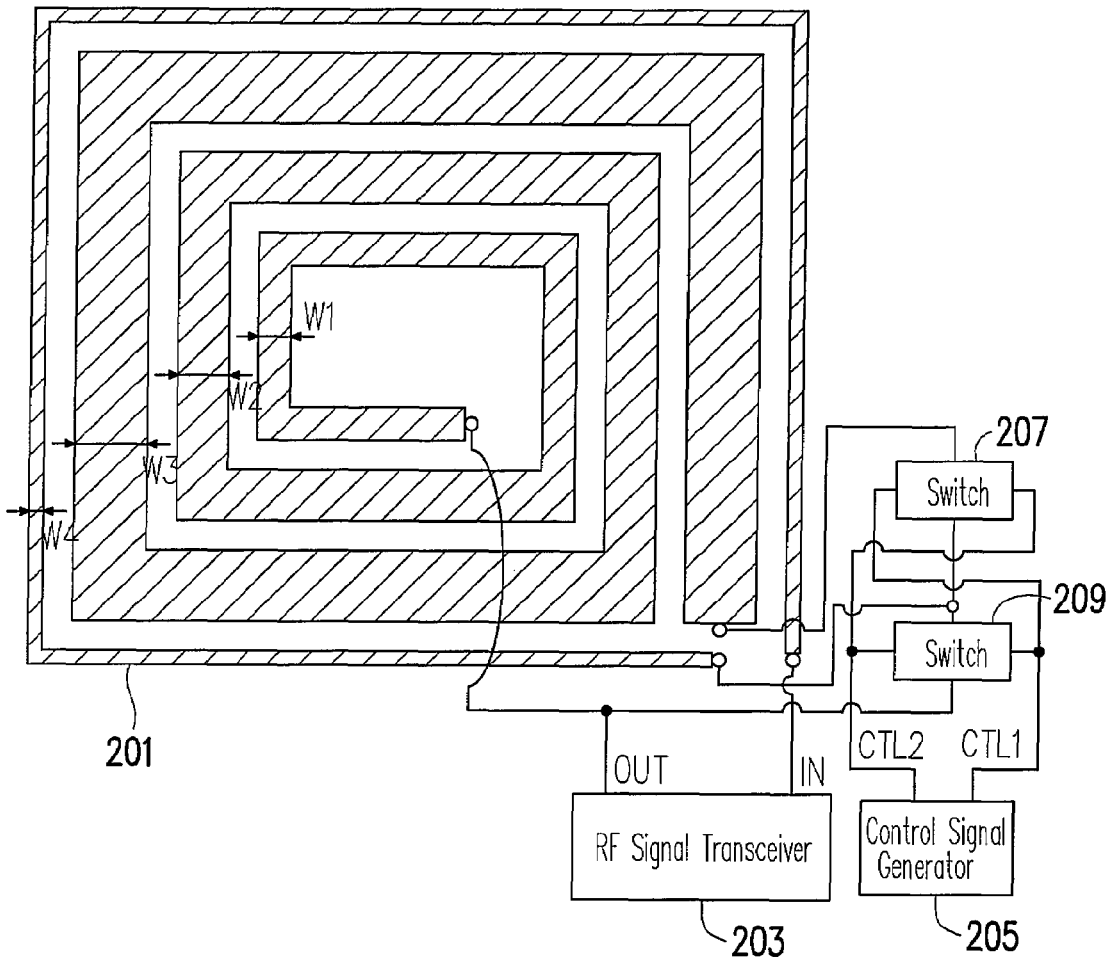
FIG. 2 is a schematic view of a wireless communication device according to a first embodiment of the present invention.

FIG. 2 is a schematic view of a wireless communication device according to a first embodiment of the present invention. As shown in FIG. 2, the wireless communication device at least includes a spiral inductor antenna 201, an RF signal transceiver 203, a control signal generator 205 and switches 207, 209.

The spiral inductor antenna 201 (for example, a tapered inductor) is characterized in that the longitudinal width is not necessarily the same. As shown in FIG. 2, in the spiral inductor antenna 201, four longitudinal widths W1-W4 are different from one another, and the relationship of the four widths may be W3>W2>W1>W4. In this embodiment, the tapered inductor is used to make the calculation of the inductance values easier.

In addition, the spiral inductor antenna 201 is also characterized in having at least a plurality of different inductance paths. Here, the inductance paths are paths along which the RF signal passes in the spiral inductor antenna 201. It is known that if the RF signal passes along different paths, the inductance values inducted may also be different. Therefore, if a plurality of different inductance paths is designed, a plurality of different inductance values can be obtained. These different inductance values are applicable to operation modes of different bands. As such, a single spiral inductor antenna can be employed to induct different inductance values, which are applicable to the wireless communication device operating at multi-band.

The RF signal transceiver 203 is coupled to the spiral inductor antenna 201. The RF signal transceiver 203 has terminals OUT and IN. The RF signal generated by the RF signal transceiver 203 is sent from the terminal OUT. The RF signal sent from outside are received by the RF signal transceiver 203 via the terminal IN.

The control signal generator 205 is coupled to the switches 207 and 209. The control signal generator 205 is used to send control signals CTL1 and CTL2 to the switches 207 and 209, so as to control the on/off of the switches 207 and 209. In this embodiment, the switches 207 and 209 are not turned on at the same time in most cases. In other words, when the switch 207 is turned on, the switch 209 is turned off, and vice versa.

The switches 207 and 209 are coupled to the spiral inductor antenna 201, the RF signal transceiver 203 and the control signal generator 205. The on/off of the switches 207 and 209 is controlled by the control signals CTL1 and CTL2 sent from the control signal generator 205. For example, when operating at 2.4 GHz, the switch 207 is turned on, and the switch 209 is turned off. On the contrary, when operating at 5.2 GHz, the switch 207 is turned off, and the switch 209 is turned on.

Figure 3:
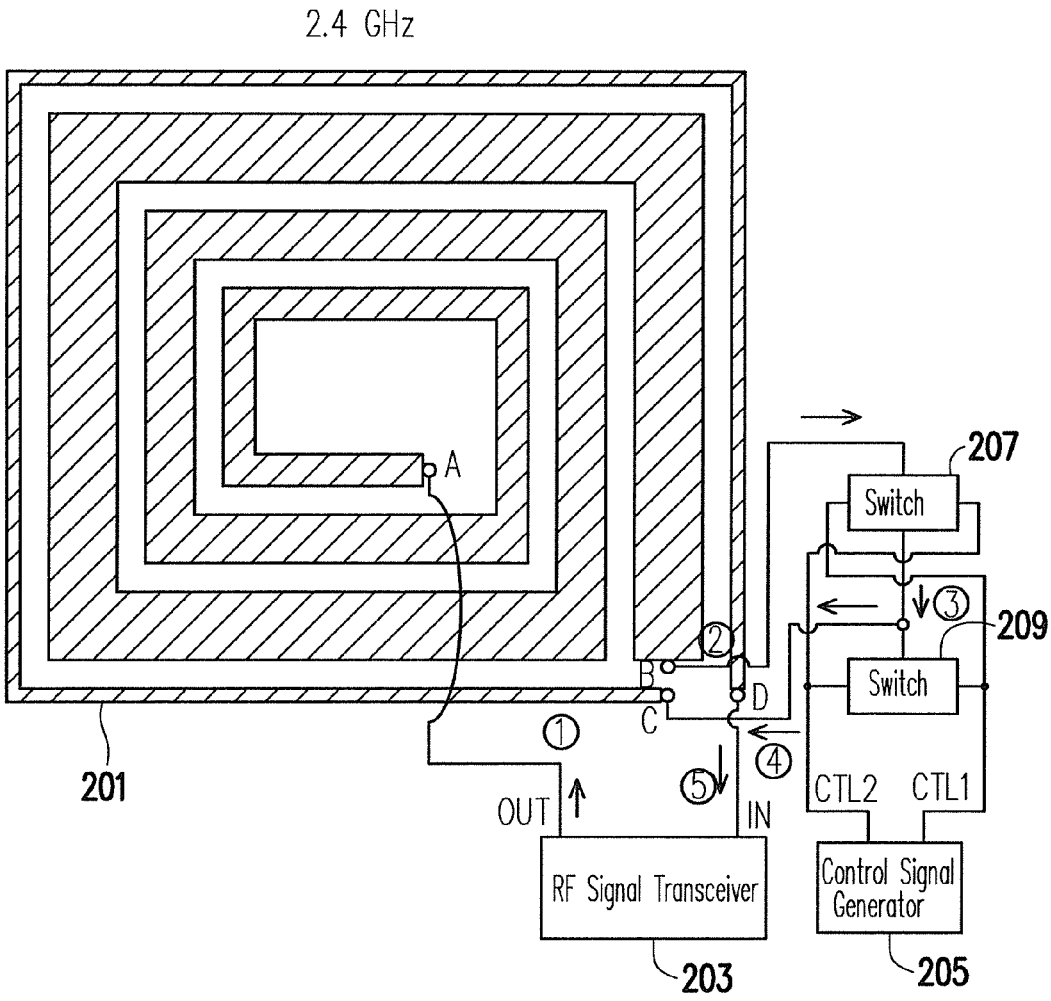
FIG. 3 is a schematic view when the first embodiment is operated at 2.4 GHz.
Figure 4:
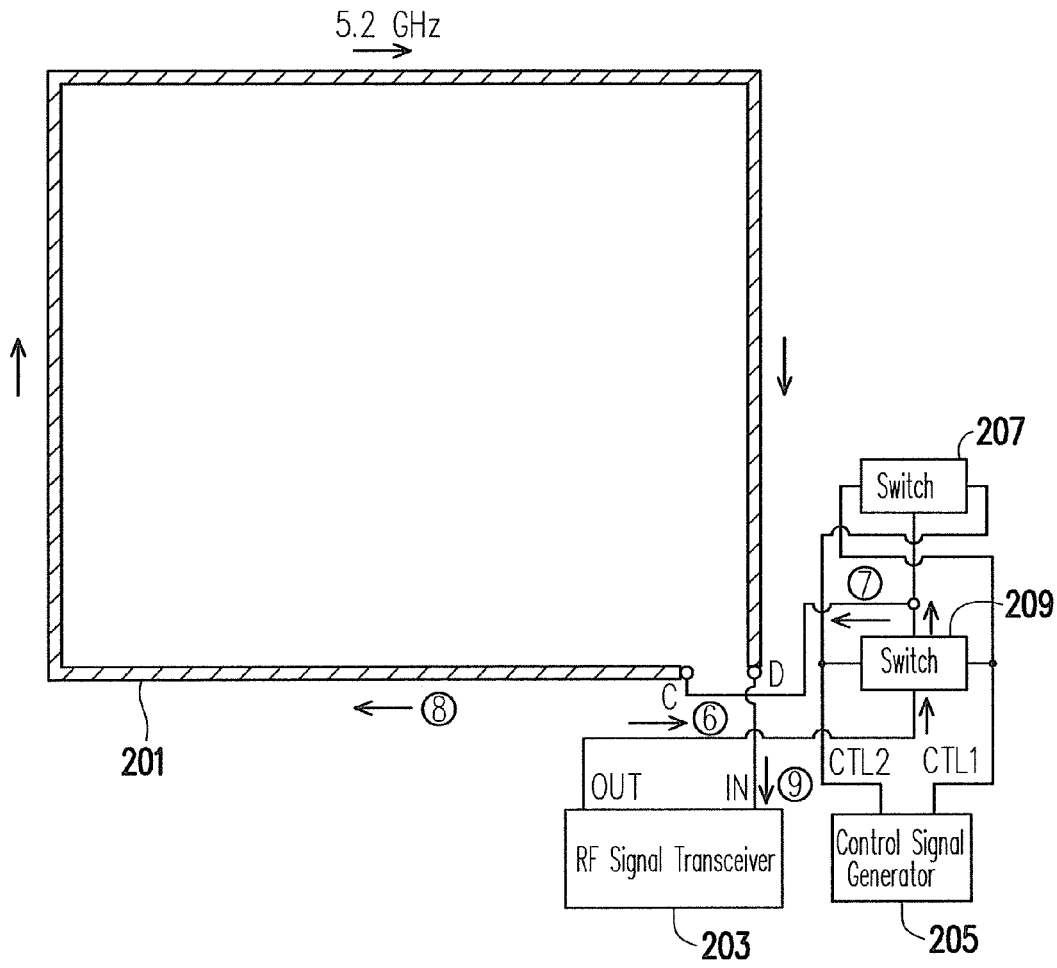
FIG. 4 is a schematic view when the first embodiment is operated at 5.2 GHz.

Referring to FIGS. 3 and 4, when this embodiment operates at 2.4 GHz or 5.2 GHz, the switching of the switches forms different inductance paths (signal paths) to realize the dual-band operation.

FIG. 3 shows the inductance path formed by the switching of the switches 207/209 when this embodiment operates at 2.4 GHz. When operating at 2.4 GHz, the switch 207 is turned on, and the switch 209 is turned off. Therefore, when this embodiment operates at 2.4 GHz, the signal path is shown by the arrows and numerals 1-5 in FIG. 3 indicates the direction of the flow of the signal more clearly.

As shown in FIG. 3, the process that the 2.4 GHz RF signal is transmitted is illustrated. The RF signal transmitted from the RF signal transceiver 203 is sent to a terminal A of the spiral inductor antennal 201 from a signal feed-out point OUT (along Path 1). Then, the RF signal is transmitted inside the spiral inductance antenna 201, and is transmitted to the switch 207 from a terminal B (along Path 2). As the switch 207 is turned on, the RF signal passes through the switch 207, and is fed to a terminal C of the spiral inductor antenna 201 (along Path 3 and Path 4). Thereafter, the RF signal is transmitted and emitted out from the outermost circle of the spiral inductor antenna 201.

Next, the receiving of the 2.4 GHz RF signal is illustrated below. The receiving path of the RF signal transmitted from the external is reversed to the transmission path described above. Finally, the RF signal transmitted from the external is received by the RF signal transceiver 203 from a terminal D (along Path 5).

As described above, when operating at 2.4 GHz, as the RF signal passes along a longer inductance path, the inducted inductance value is greater.

FIG. 4 shows the inductance path formed by the switching of the switches 207/209 when this embodiment operates at 5.2 GHz. When operating at 5.2 GHz, the switch 207 is turned off, and the switch 209 is turned on. Therefore, when operating at 5.2 GHz, the signal path is shown as the arrows and numerals 6-9 in FIG. 4 indicates the direction of the flow of the signal more clearly.

As shown in FIG. 4, the process that the 5.2 GHz RF signal is transmitted is illustrated. The RF signal transmitted from the RF signal transceiver 203 is sent from the switch 209 from the signal feed-out point OUT (along Path 6). As the switch 209 is turned on, the RF signal passes through the switch 209, and is fed to the terminal C of the spiral inductor antenna 201 (along Path 7). Then, the RF signal is transmitted and emitted out from the outermost circle of the spiral inductor antenna 201 (along Path 8).

Next, the receiving of the 5.2 GHz RF signal is illustrated below. The receiving path of the RF signal transmitted from the external is reversed to the transmission path described above. Finally, the 5.2 GHz RF signal transmitted from the external is received by the RF signal transceiver 203 from the terminal D (along Path 9).

As described above, when operating at 5.2 GHz, as the RF signal passes along a shorter inductance path, the inducted inductance value is smaller.

Moreover, it is known to those skilled in the art from the description of this embodiment that if the single spiral inductor antenna is designed to have a plurality of different induction paths, and to be used together with a plurality of switches, this embodiment can be expanded to be applied to the multi-band operation mode.

Figure 5:
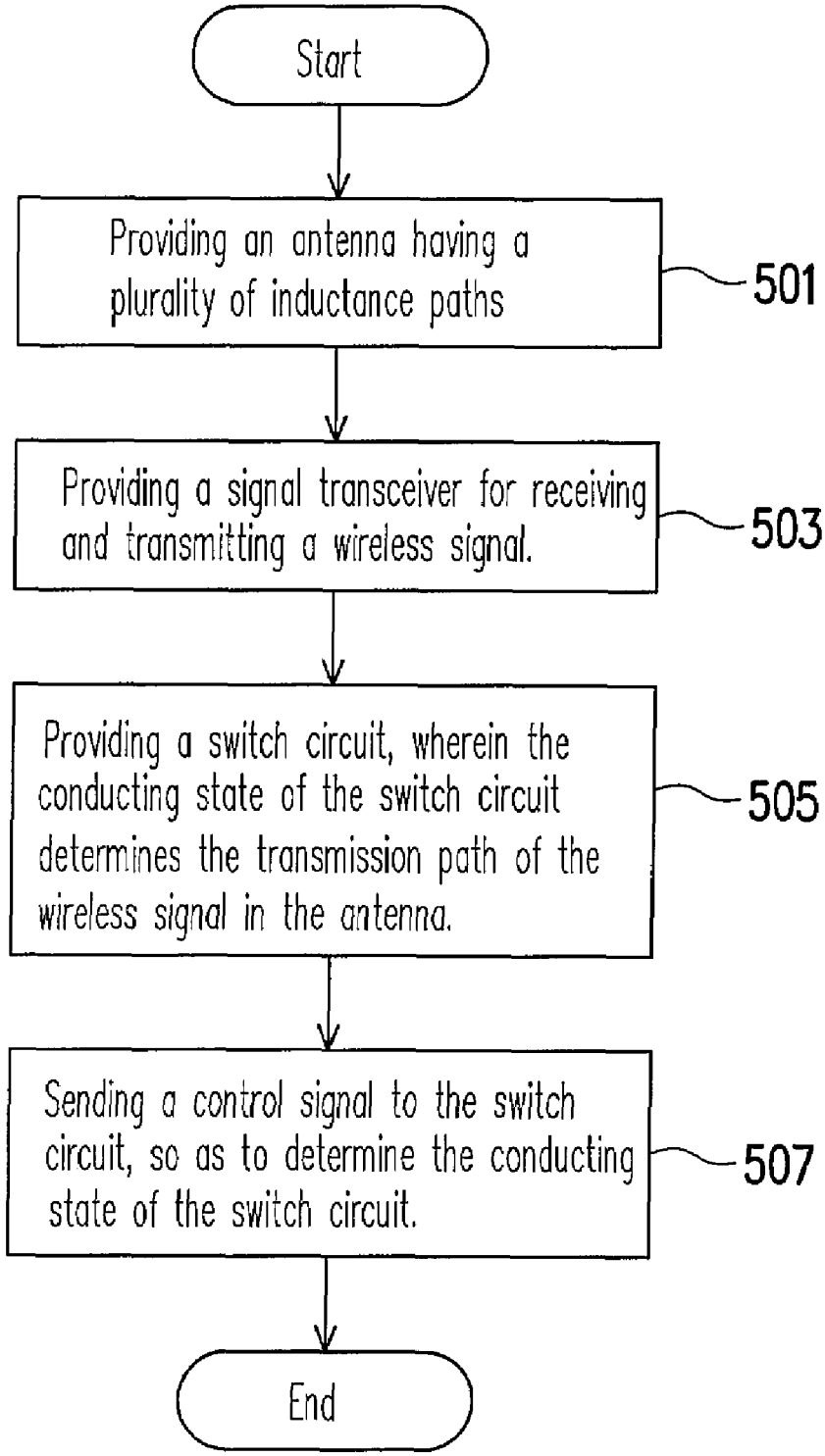
FIG. 5 is a flow chart of a wireless signal receiving/transmitting method according to a second embodiment of the present invention.

The wireless signal transmitting/receiving method of another embodiment of the present invention is illustrated below. As shown in FIG. 5, firstly, a single spiral inductor antenna having a plurality of inductance paths is provided, as shown in Step 501. A signal transceiver is provided to receive and transmit a wireless signal, as shown in Step 503. A switch circuit is provided, and the conducting state of the switch circuit determines the transmission path of the wireless signal in the antenna, as shown in Step 505. In Step 505, the switch circuit, for example, includes the switches 207 and 209 of FIG. 2, and the on/off states of the switches determine how the wireless signal is transmitted in the antenna, so as to be adapted to the multi-band operation. A control signal generator is used to send a control signal to the switch circuit, so as to determine the conducting state of the switch circuit, as shown in Step 507. In Step 507, for example, when a switch is turned on, the wireless signal is received and transmitted at a certain band; while when another switch is turned on, the wireless signal is received and transmitted at another band. Thus, a single spiral inductor antenna can be used to realize the multi-band operation.

The present invention has been disclosed above in the preferred embodiments, but is not limited to those. It is known to persons skilled in the art that some modifications and innovations may be made without departing from the spirit and scope of the present invention. Therefore, the scope of the present invention should be defined by the following claims.

What is claimed is:

1. A wireless communication device, comprising:

an antenna, having at least a first inductance path and a second inductance path, wherein the inductance values inducted by the first inductance path and the second inductance path are different;

a signal transceiver, coupled to the antenna, wherein the signal transceiver receives and transmits a wireless signal; and a switch circuit, coupled to the antenna and the signal transceiver, wherein the conducting state of the switch circuit determines whether the wireless signal is transmitted on the first inductance path or the second inductance path in the antenna, and only one of the first inductance path and the second inductance path is conducted at the same time.

2. The wireless communication device as claimed in claim 1, further comprising:

a control signal generator, for sending a control signal to the switch circuit to determine the conducting state of the switch circuit.

3. The wireless communication device as claimed in claim 2, wherein the switch circuit comprises:

a first switch, coupled to the antenna, the signal transceiver and the control signal generator, wherein when the first switch is turned on, the wireless signal is transmitted on the first inductance path; and a second switch, coupled to the antenna, the signal transceiver and the control signal generator, wherein when the second switch is turned on, the wireless signal is transmitted on the second inductance path.

4. The wireless communication device as claimed in claim 1, wherein the antenna is a spiral inductor antenna.

5. A wireless communication device, operating at a first band and a second band, comprising:

an antenna, having at least a first inductance path and a second inductance path, wherein the first inductance path is corresponding to an operation of the wireless communication device at the first band, and the second inductance path is corresponding to an operation of the wireless communication device at the second band;

a signal transceiver, coupled to the antenna, wherein the signal transceiver receives and transmits a wireless signal;

a first switch and a second switch, coupled to the antenna and the signal transceiver, wherein the on/off states of the first switch and the second switch determine whether the wireless signal is transmitted on the first inductance path or the second inductance path in the antenna; and a control signal generator, determining the on/off states of the first switch and the second switch.

6. The wireless communication device as claimed in claim 5, wherein the antenna is a spiral inductor antenna.

7. A wireless communication device, operating at multi-band, comprising:

a single spiral inductor antenna, having a plurality of inductance paths, wherein the inductance values inducted by the inductance paths are different from one another, and different inductance paths are corresponding to operations at different bands;

a wireless signal transceiver, for receiving and transmitting a wireless signal;

a plurality of switches, wherein the on/off states of the switches determine which inductance path the wireless signal is transmitted on in the antenna; and a control signal generator, for sending a control signal to the switches, so as to determine the on/off states of the switches.

8. The wireless communication device as claimed in claim 7, wherein the antenna has at least a first inductance path and a second inductance path.

9. The wireless communication device as claimed in claim 8, wherein the switches comprise:

a first switch and a second switch, coupled to the antenna and the signal transceiver, wherein the on/off states of the first switch and the second switch determine whether the wireless signal is transmitted on the first inductance path or the second inductance path in the antenna.

10. A wireless signal receiving/transmitting method, comprising:

providing a spiral inductor antenna, having a plurality of inductance paths;

providing a wireless signal transceiver, for receiving and transmitting a wireless signal;

providing a switch circuit, wherein the conducting state of the switch circuit determines the transmission path of the wireless signal in the antenna; and using a control signal generator to send a control signal to the switch circuit, so as to determine the conducting state of the switch circuit.

11. The wireless signal receiving/transmitting method as claimed in claim 10, wherein the spiral inductor antenna has at least a first inductance path and a second inductance path.

12. The wireless signal receiving/transmitting method as claimed in claim 11, wherein the switch circuit comprises:

a first switch and a second switch, wherein the on/off states of the first switch and the second switch determine whether the wireless signal is transmitted on the first inductance path or the second inductance path in the spiral inductor antenna.

* * * * *